United States Patent [19]

Lin

[11] Patent Number: 4,842,447

[45] Date of Patent: Jun. 27, 1989

[54] MANUFACTURING METHOD AND DEVICE OF HOLLOW-TYPED REVERSE CIRCULATING PILES

[76] Inventor: Juei-Jse Lin, 4th Fl., 39, Szu Chuan Rd., Sec. 2, Panchiao,, Taipei Hsien, Taiwan

[21] Appl. No.: 111,435

[22] Filed: Oct. 21, 1987

[51] Int. Cl.[4] ..... E02D 5/30

[52] U.S. Cl. ..... 405/243; 405/232; 405/233

[58] Field of Search ..... 405/233, 133, 249, 248, 405/241, 242, 239, 240, 229

[56] References Cited

U.S. PATENT DOCUMENTS

| | | | |
|---|---|---|---|
| 100,705 | 3/1870 | Kleckney | 465/249 X |
| 1,071,985 | 9/1913 | Conkling | 405/249 |
| 1,161,512 | 11/1915 | Nitsche | 405/133 X |
| 2,010,406 | 8/1935 | Martin | 405/133 |
| 3,254,492 | 6/1966 | Menard | 405/233 |
| 3,307,361 | 3/1967 | Waterman | 405/133 X |
| 3,839,874 | 10/1974 | Wyant | 405/233 |
| 4,031,708 | 6/1977 | Hanson | 405/133 |
| 4,180,350 | 12/1979 | Watts | 405/233 |

*Primary Examiner*—Dennis L. Taylor
*Attorney, Agent, or Firm*—Lowe, Price, LeBlanc, Becker & Shur

[57] ABSTRACT

The invention is related to a kind of fabrication method and device of hollow reverse circulation piles of which the central hollow portion is installed with a movable sand barrel between which and the surrounding reinforcing cage, positioning device for movable sand barrel is installed. For starting the work, grouting to scheduled height from bottom of pile bore is made first and then grouting between pile bore wall and outer wall of movable sand barrel is conducted. Meanwhile, sands are poured into movable sandbarrel. By virtue of sensors on the inner and outer walls of movable sand barrel, the pressure between concrete grout and sand will be kept in equilibrium to avoid reverse grouting due to opposite pressure. Then, the sand barrel is pulled up step by step so that the pile poured with sand at its central part is primarily completed. Water is finally poured into the central part and sand is suctioned out to complete the hollow-typed reverse circulation pile. Its distinctive features are simplified and quick work process at low cost with high commercial value.

4 Claims, 9 Drawing Sheets

MANUFACTURING METHOD AND DEVICE OF HOLLOW-TYPED REVERSE CIRCULATING PILES

BACKGROUND OF THE INVENTION:

The invention is related to the foundation work of civil engineering and architecture (construction) engineering especially referring to the fabrication and utilization of reverse circulation drillingtyped foundation piles which are suitable for deep foundation works.

The traditional fabrication method of cast-in-place hollow piles formed by reverse circulation drilling method uses pipe-shaped steel molds to confine concrete grout for making the interior hollow. This method is not practical for deep foundation works as it is hard to control appropriate time for taking mold apart because of difference of depth, difference of pressure and change of temperature. If the mold is taken apart before solidification, the whole piece may be collapsed. If the mold is taken apart after solidification, the pile is usually broken.

After study and test, the applicant provides an idea that sands are poured in the central hollow part to have the same pressure as that of the surrounding concrete grout. Upon solidification of concrete grout, sands are suctioned out to complete a hollow pile.

SUMMARY OF THE INVENTION

The manufacturing method and device of a kind of hollow-typed reverse circulation foundation piles is the arrangement as follows:

In the central hollow portion of pile, a movable (up & down) sand barrel is placed. Between the movable sand barrel and the surrounding reinforcing cage, the positioning device for the movable sand barrel is installed. Upon start of work, grouting is pored to a scheduled height from the bottom of the pile bore first. Grouting is then pored between pile bore wall and outer wall of movable sand barrel. Meanwhile, sands are poured into movable sand barrel. By virtue of sensors on the inner and outer walls of movable sand barrel, the pressure between concrete grout and the sand will be kept in equilibrium to avoid reverse grouting due to opposite pressure. Then, the sand barrel is gradually pulled up step by step so as to primarily complete the pile poured with sand at its central part. Finally, water is poured in to the central part and sand is suctioned out to complete the hollow-typed reverse circulation pile. Its distinctive features are simplified and quick work process at low cost with high commercial value.

DETAILED DESCRIPTION OF THE PREFERRED EMBODIMENT

Figure 1:
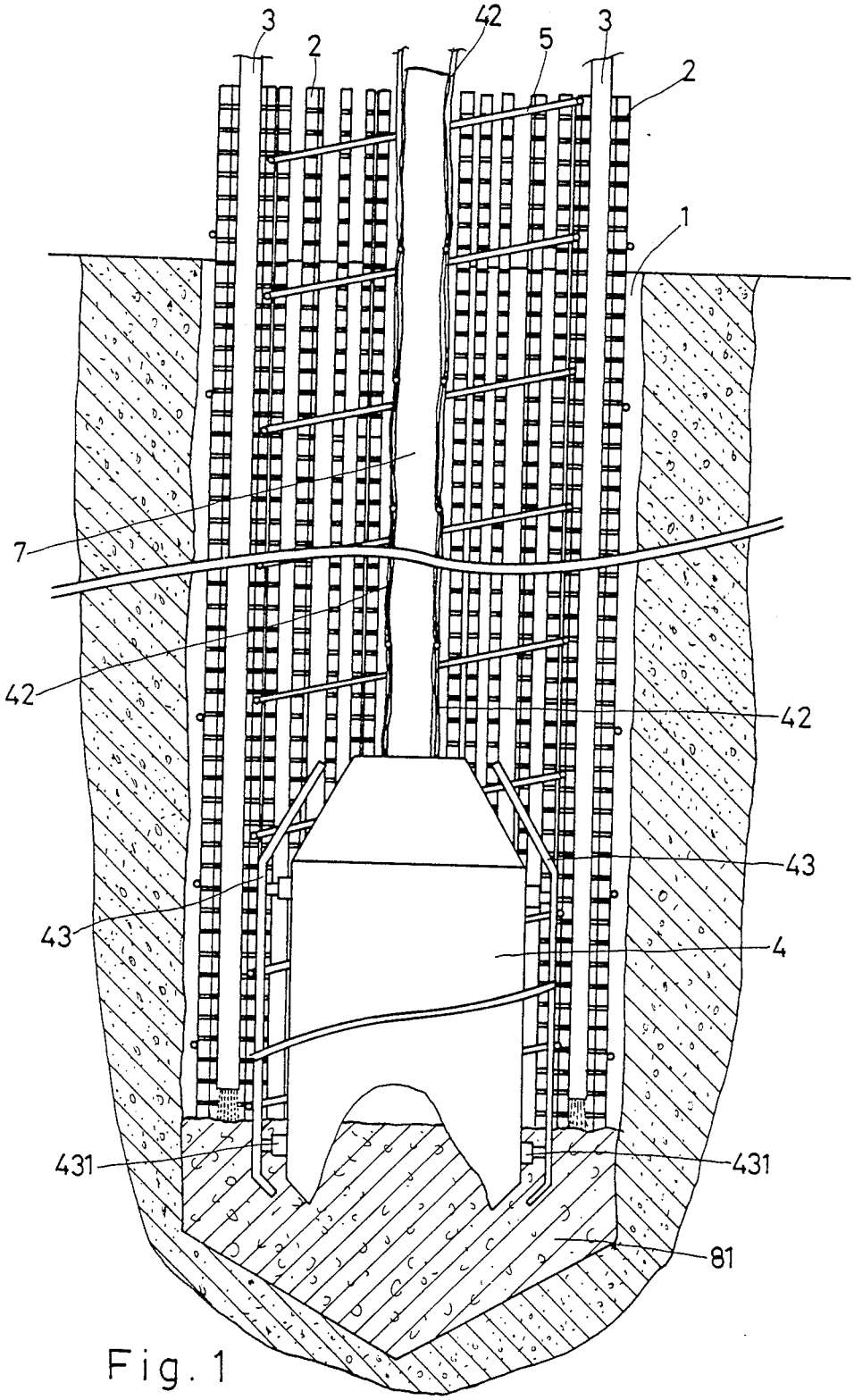
FIG. 1 illustrates the sectional view of step 1 of the preferred embodiment of the invention.
Figure 2:
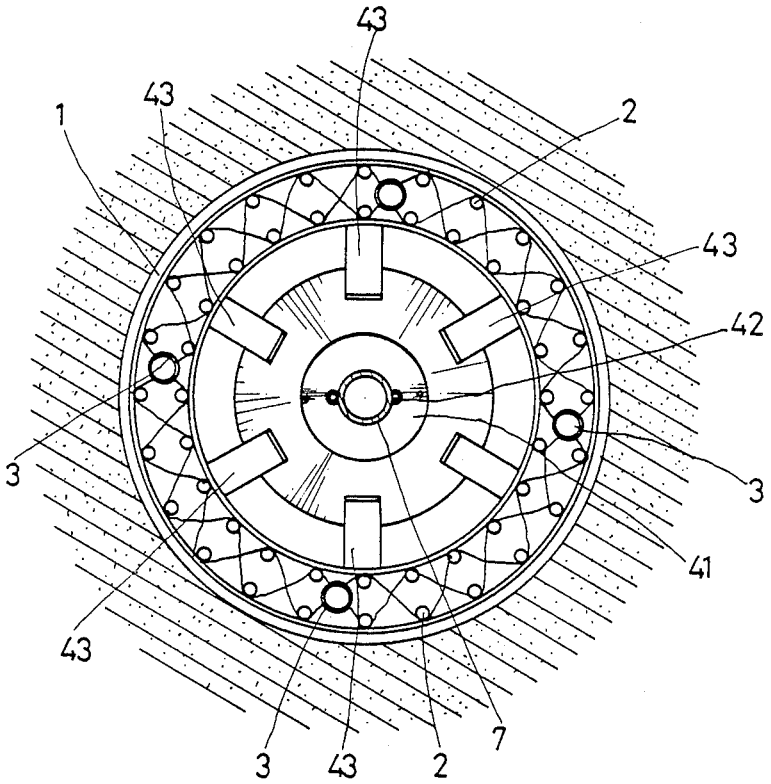
FIG. 2 illustrates the top view of the embodiment shown in FIG. 1.

Please refer to FIGS. 1 & 2, the preferred embodiment of the invention is as follows:

Around a pile bore (1), the reinforcing cage (2) is placed. In the reinforcing cage, several concrete grouting pipes (3) are inserted. At the central part of the pile bore (1), it is installed with a movable (up & down) sand barrel (4) of which the outer diameter is smaller than the inner diameter of the reinforcing cage (2). In between the movable sand barrel (4) and reinforcing cage (2), it is equipped with positioning device (5) for the movable sand barrel so that the movable sand barrel (4) can freely move up and down within a fixed scope without any swinging. In addition, the top board (41) above the movable sand barrel (4) is connected with a steel cable (42) at the top for placing in or pulling up the movable sand barrel (4). The central part of the top board (4) permits sand pouring pipe (7) penetration (see FIG. 3). Step 1 in the method of this invention is the pouring of grouting (81) on the bottom of pile bore (1) up to the scheduled height as shown in FIG. 1.

Figure 3:
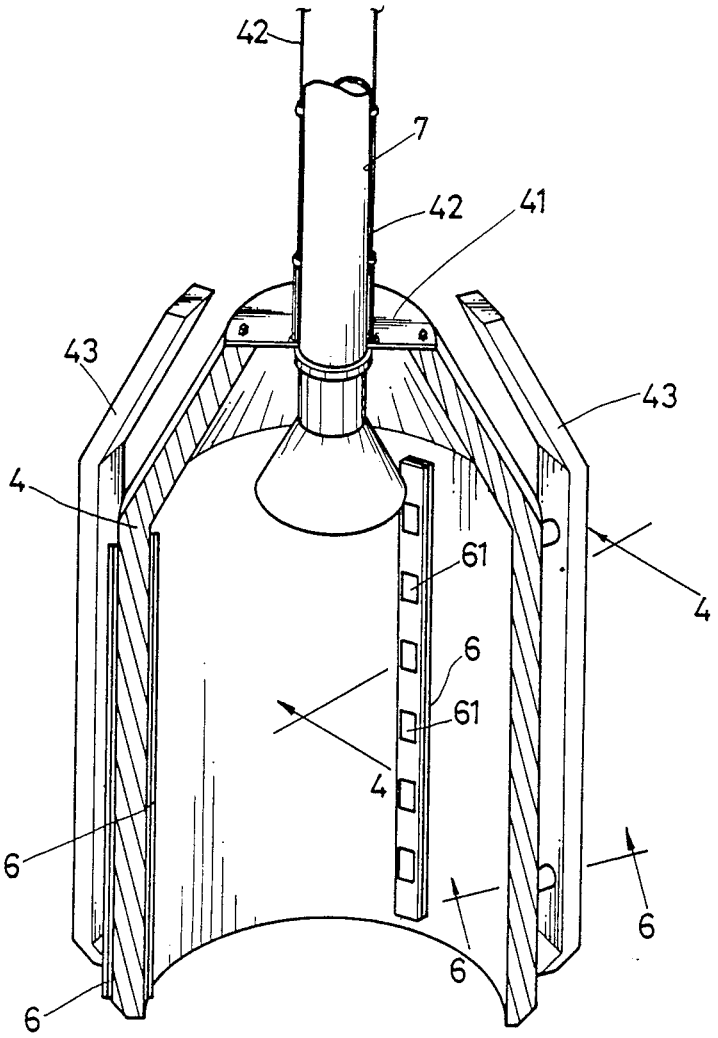
FIG. 3 illustrates the partially sectional elevation drawing of the movable sand barrel of the preferred embodiment of the invention.

Please refer to FIG. 3, in equal angles around the movable sand barrel, several guide plates (43) are erected to facilitate the movable sand barrel's (4) successful vertical movement along inner edge of the reinforcing cage (2). Furthermore, on the inner and outer walls of the movable sand barrel (4), sensor (6) devices are installed. In equal angles and definite distance on the inner and outer walls, sealed sensing element (61) are installed so that at the moment of inner and outer walls bearing the pressure of concrete grout or sand, it will send signal upward to control box informing the operator the height and height ratio between concrete grout and sand poured in.

Figure 4:
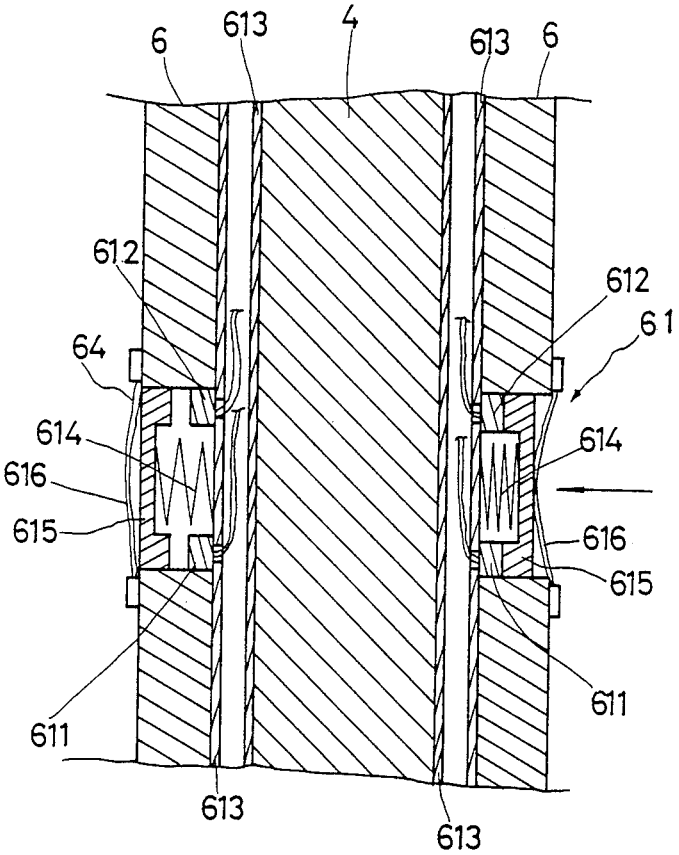
FIG. 4 illustrates the sectional view of sensor along cross section line 4—4 and the direction indicated by arrowheads in FIG. 3, the sensor at the right shows the status being pressed.
Figure 5:
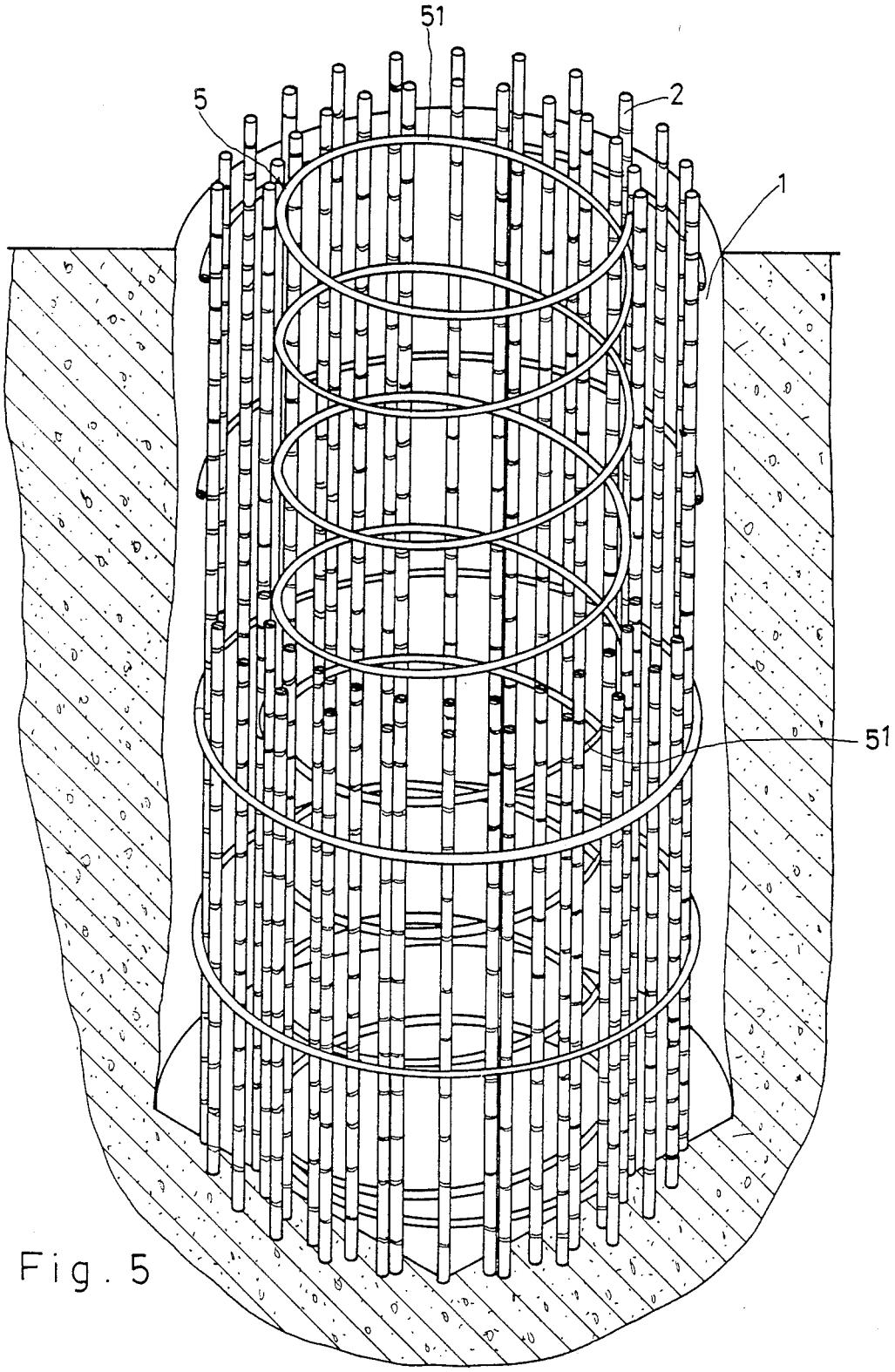
FIG. 5 illustrates the sectional elevation view of the positioning device with inner loop rings as preferred embodiment of the invention.
Figure 6:
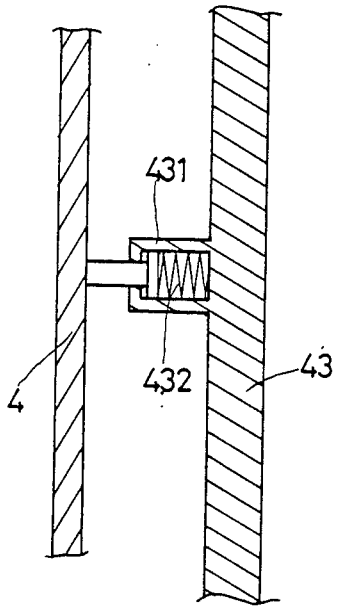
FIG. 6 illustrates the sectional view along cross section line 6—6 and the direction indicated by arrowhead in FIG. 3.
Figure 7:
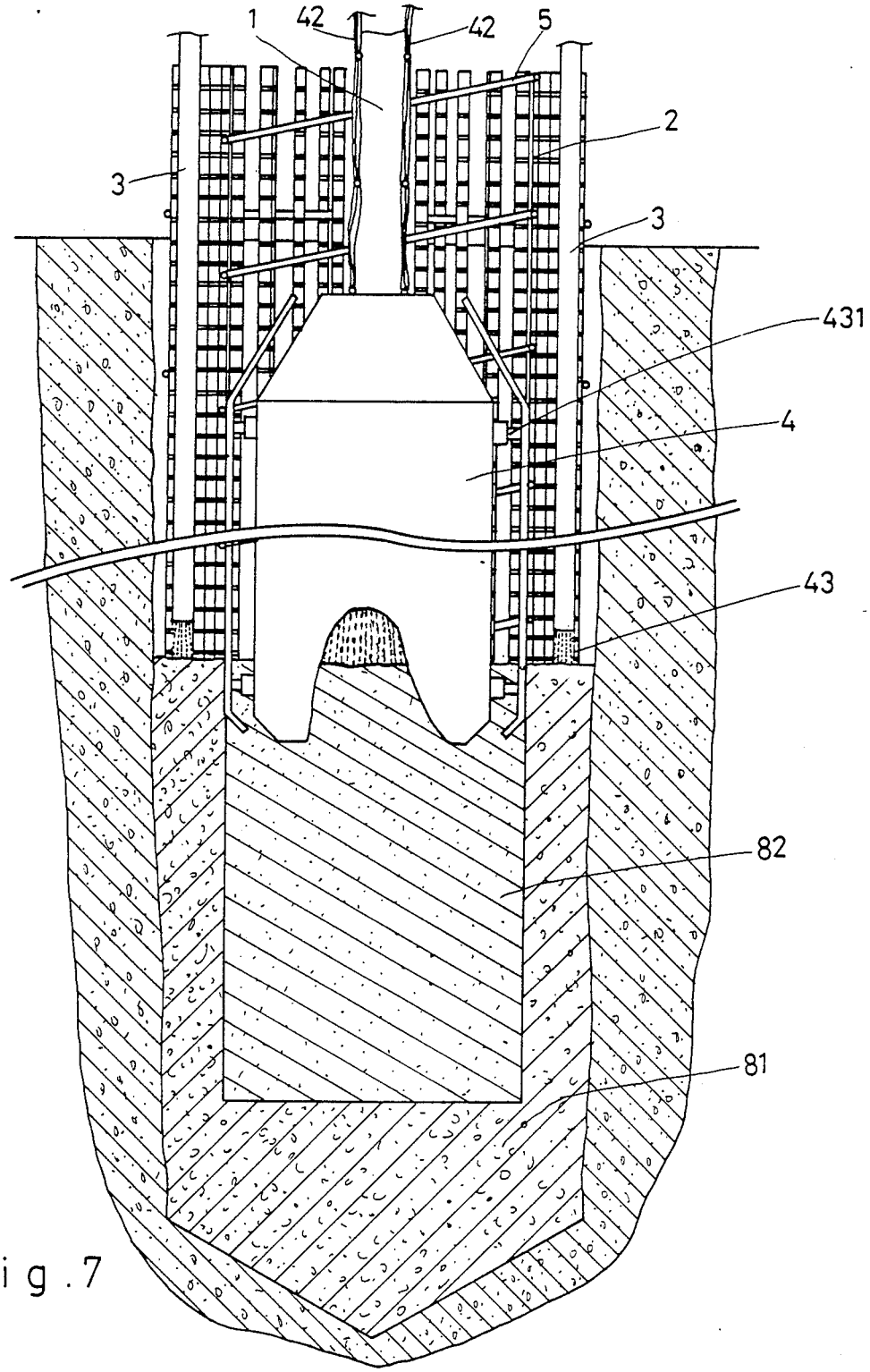
FIG. 7 illustrates the cross sectional drawing of step 2 of the preferred embodiment of the invention.

Please refer to FIG. 4 which illustrates the embodiment of sensing element (61) and the cross sectional drawing of conditions of bearing pressure and not bearing pressure. The sensing element (61) is on an insulator (613) with contact point 1 (611) and contact point 2 (612). Both contact points (Taps) (611) & (612) connect a leading wire respectively for transmitting signals. Outside of the two contact points, a conduct piece (61) lifted by spring (614) is installed. The outer edge of the conduct piece (615) has opening and is sealed by a film piece (616). The sensing element (61) at the right side of FIG. 4 is in the condition that film piece (616) bearing pressure pushes conduct piece (615) inward to make both contact points (611) (612) on. Please refer to FIG. 5 which illustrates the positioning device (5) of the movable sand barrel (4) in the embodiment of the invention. The figure shows that spiral steel bars are fastened at the inner edge of reinforcing cage (2) to construct an inner loop ring (51). It may alternately be constructed by fastening several ring-shaped steel bars in definite distance at the inner edge of the reinforcing cage. FIG. 6 illustrates that telescopic rod (431) and spring (432) are installed between the guide board (43) and the movable sand barrel (4) so as to make the guide board (43) flexible for adapting the variation of reinforcing cage (2) inner diameter to facilitate the movable sand barrel (4) freely moving in the inner loop ring (51). Please refer to FIG. 7 which illustrates step 2 succeeding FIG. 1. Between inner wall of pile bore (1) and outer wall of movable sand barrel (4), concrete grout (81) is continually poured in and sand (82) is poured into movable sand barrel. By virtue of sensing device (6), the amount of concrete grout (81) and (82) is controlled for keeping their definite height ratio to maintain equilibrium pressure so as to avoid reverse pressure for pouring in another from one poured in excess amount. The abovementioned sand (82) should be selected as possible to have specific gravity close to that of concrete grout (81). If the specific gravity is lower than that of concrete grout, more sand, in accordance with calculation, should be poured in for maintaining pressure equilibrium.

Figure 8:
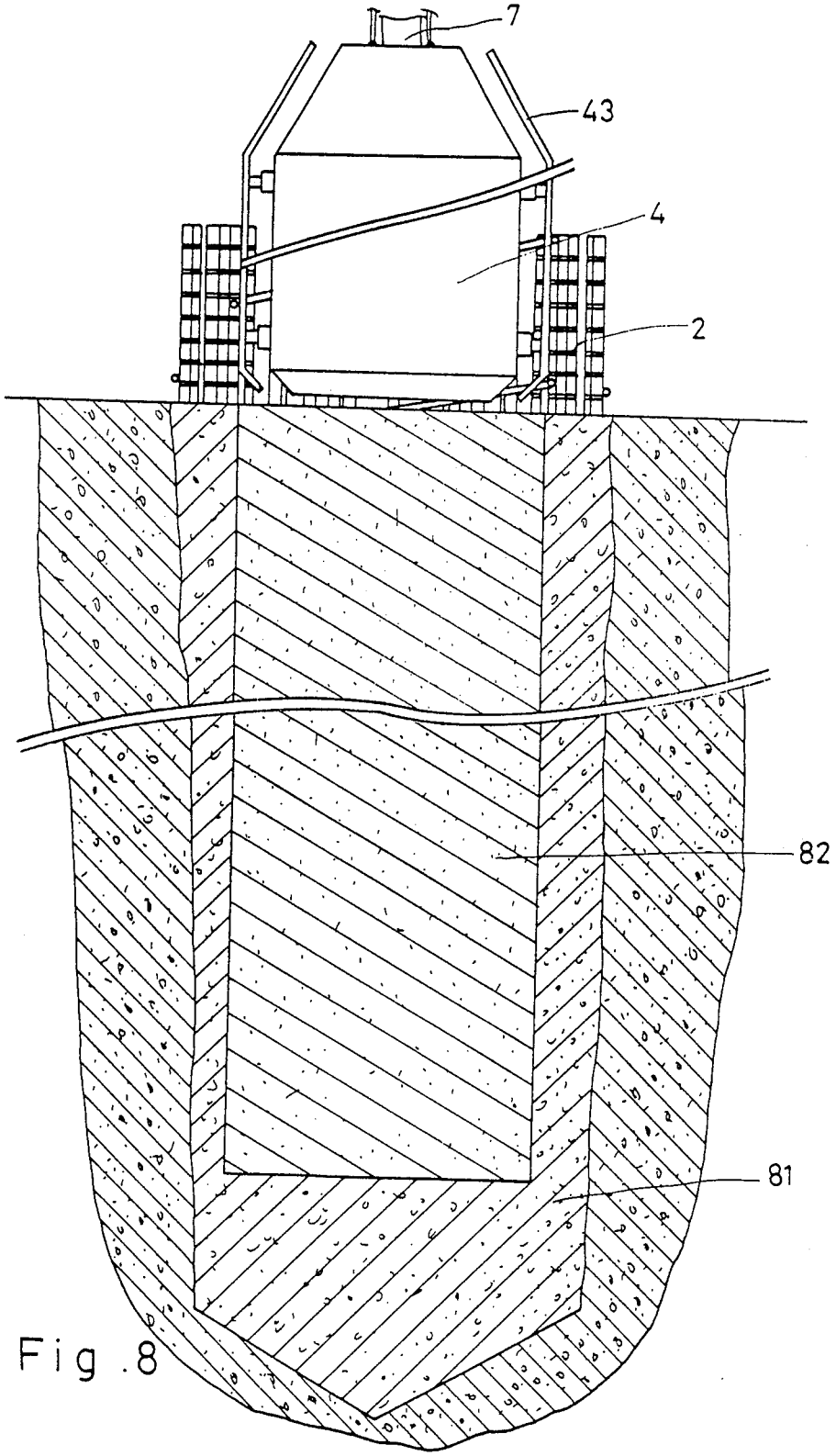
FIG. 8 illustrates the cross sectional drawing of step 3 of the preferred embodiment of the invention.
Figure 9:
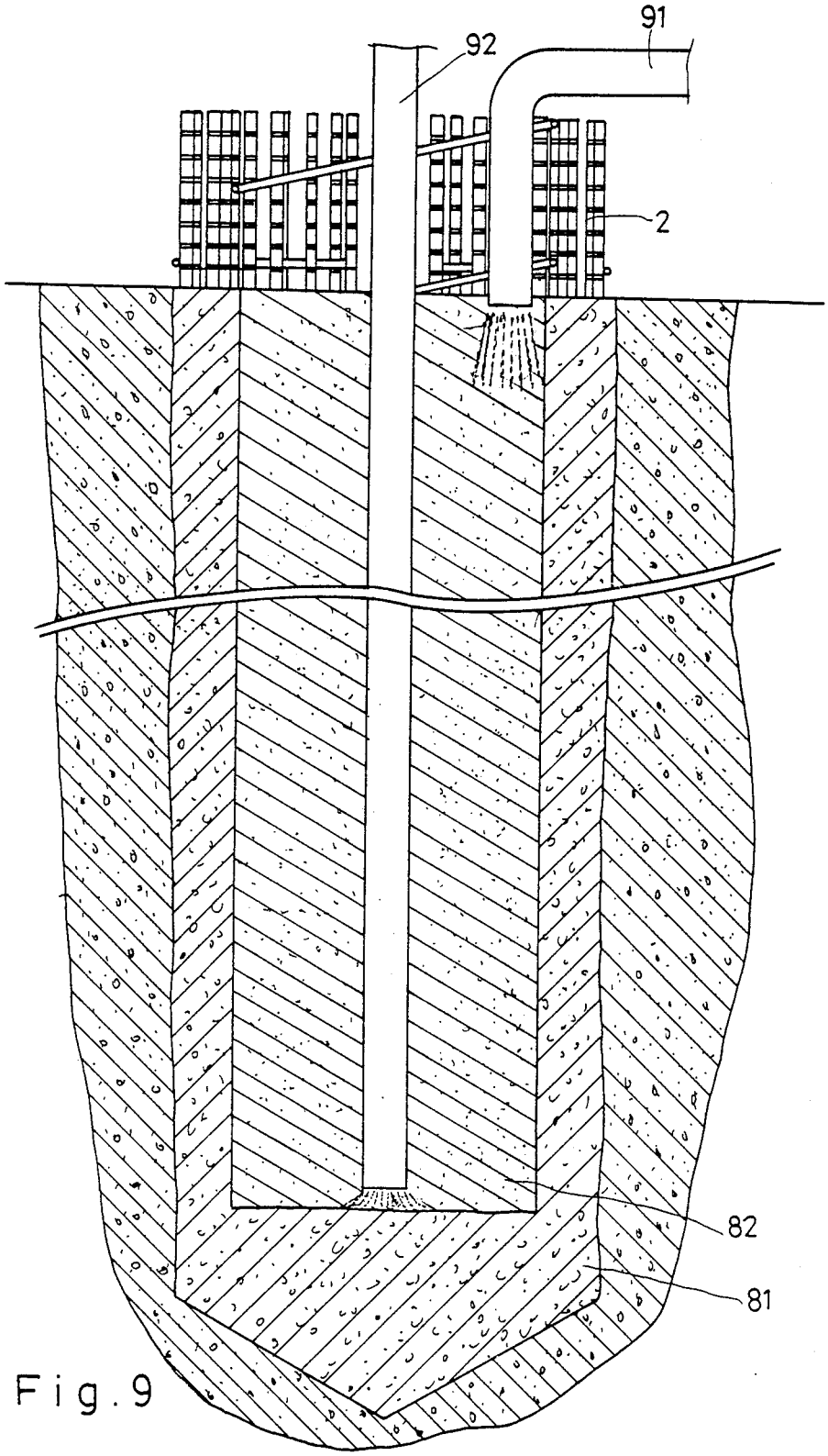
FIG. 9 illustrates the cross sectional drawing of step 4 of the preferred embodiment of the invention.

Please refer to FIG. 8. In the manner stated in description of FIG. 7, the pouring amount of concrete grout (81) and sand (82) is controlled and the movable said barrel (4) is pulled up at the same time so that the work process of grouting and sand pouring will be completed step by step. As confinement of movable sand barrel (4) is just poured in with concrete grout (81) and sand (82) within its scope, it will not create opposite pressure for reverse pouring because of slight improper control of grouting (81) or sand (82) pouring during operation. Furthermore, as the moveable sand barrel (4) is continually moving upward before solidification of concrete grout (81), it is very easy to pull up the movable sand barrel (4) because of less contact area and relatively reduced frictional force. The movable sand barrel (4) will be taken out of pile when it reaches ground surface. Consequently, a pile with shoe at bottom, concrete grout in circumference and sand at central is primarily completed. Please refer to FIG. 9 which illustrates that after solidification of concrete grout (81), water is poured into sand through water pouring pipe (91) and sand is suctioned out by sand suction pipe (92) for forming a hollow pile. After filtration of water, the sand taken out can be continuously re-used and the movable sand barrel (4) can also be re-used for fabrication of other hollow piles.

I claim:

1. A method for forming a hollow type reverse circulation foundation pile comprising the steps of:

providing a pile bore, reinforcing cage therein disposed against the wall of said bore, and grouting pipes extending to the bottom of said bore disposed within said reinforcing cage, said reinforcing cage defining a central open area;

providing a movable sand barrel adapted to move vertically within the central part of said reinforcing cage, the outer diameter of sad movable sand barrel being smaller than the inner diameter of the reinforcing cage;

providing sand pouring pipes extending into the moveable sand barrel;

providing sensing means around the surface of the moveable sand barrel for sensing inner and outer pressure thereon;

pouring grouting through said grouting pipes into the bottom of said bore until the grouting has reached a predetermined height, moving said sand barrel to the upper surface of said pored grouting;

pouring grouting through said grouting pipes into the reinforcing cage surrounding said sand barrel while pouring sand through said sand pipes into said sand barrel;

equalizing the inner and outer pressure on the wall of said sand barrel;

successively moving said sand barrel upwardly through said bore as said grouting is poured into said reinforcing cage and sand is deposited into the hollow central portion through said sand barrel until the pile has been formed; and after solidification of said concrete grout pouring water into said sand and sucking sand out of the foundation pile to provide the hollow type reverse circulation foundation pile.

2. The method of claim 1 further comprising providing a positioning means surrounding the hollow central interior of said reinforcing cage for positioning said moveable sand barrel therein against lateral movement.

3. The method of claim 2 wherein said positioning means is a steel bar helix.

4. The method of claim 1 wherein sensing elements are installed on the inner and outer walls of the moveable sand barrel equidistantly apart and at predetermined vertical distances.

* * * * *